US008177591B2

(12) United States Patent
Okamura et al.

(10) Patent No.: US 8,177,591 B2
(45) Date of Patent: May 15, 2012

(54) TERMINAL FITTING AND ELECTRICAL CABLE EQUIPPED WITH THE SAME

(75) Inventors: Kenji Okamura, Yokkaichi (JP); Masaaki Tabata, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 13/002,525

(22) PCT Filed: Jun. 8, 2009

(86) PCT No.: PCT/JP2009/060470
§ 371 (c)(1),
(2), (4) Date: Jan. 4, 2011

(87) PCT Pub. No.: WO2010/010758
PCT Pub. Date: Jan. 28, 2010

(65) Prior Publication Data

US 2011/0124247 A1 May 26, 2011

(30) Foreign Application Priority Data

Jul. 22, 2008 (JP) ..... 2008-189033

(51) Int. Cl.
*H01R 4/18* (2006.01)

(52) U.S. Cl. ..... 439/877

(58) Field of Classification Search ..... 439/882, 439/877, 442
See application file for complete search history.

(56) References Cited

U.S. PATENT DOCUMENTS 3,496,520 A * 2/1970 Reynolds ..... 439/442
3,533,055 A 10/1970 Zak
(Continued)

FOREIGN PATENT DOCUMENTS

JP 55-96575 7/1980
(Continued)

OTHER PUBLICATIONS

Microfilm of the specification and drawings annexed to the request of JP043838/1979 (Laid-open No. 142887/1980).

*Primary Examiner* — Briggitte R Hammond
(74) *Attorney, Agent, or Firm* — Gerald E. Hespos; Michael J. Porco

(57) ABSTRACT

A terminal fitting 10 includes a main body 20 to be coupled to a mating conductor, and a crimp contact section 30 rearward from the main body 20. The crimp contact section 30 is crimped on an end of a core wire 42 in a covered electrical cable 40 so as to surround the end. The core wire 42 includes a plurality of metallic strands 41 and is covered with a sheath 43 to form the covered electrical cable 40. Serrations 34 are provided on a contact surface of the crimp contact section 30 for surrounding the core wire 42. Each serration 34 is a polygonal shaped recess with which the core wire 42 engages upon crimping. Both diagonal corner portions 34C of each serration 34 are rounded. Thus, the whole periphery of an opening edge around the recess penetrates an oxide layer on a core wire.

8 Claims, 7 Drawing Sheets

U.S. PATENT DOCUMENTS

| | | | | | |
|---|---|---|---|---|---|
| 3,594,702 | A * | 7/1971 | Frey | 439/442 |
| 3,633,156 | A * | 1/1972 | Teagno et al. | 439/850 |
| 3,670,293 | A * | 6/1972 | Garver | 439/585 |
| 3,892,459 | A * | 7/1975 | Dittmann et al. | 439/442 |
| 3,990,143 | A * | 11/1976 | Dittmann et al. | 439/877 |
| 4,142,771 | A * | 3/1979 | Barnes et al. | 439/882 |
| 6,056,605 | A * | 5/2000 | Nguyen et al. | 439/882 |
| 6,951,483 | B2 * | 10/2005 | Kameyama | 439/595 |
| 7,494,388 | B2 * | 2/2009 | Kakuta | 439/877 |
| 2005/0164566 | A1 * | 7/2005 | Zhao et al. | 439/851 |

FOREIGN PATENT DOCUMENTS

| | | |
|---|---|---|
| JP | 642359 | 1/1989 |
| JP | 5-152011 | 6/1993 |
| JP | 10-125362 | 5/1998 |
| JP | 2003249284 | 2/2002 |

* cited by examiner

TERMINAL FITTING AND ELECTRICAL CABLE EQUIPPED WITH THE SAME

BACKGROUND OF THE INVENTION

1. Field of the Invention

This invention relates to a terminal fitting and an electrical cable equipped with the same.

2. Description of the Related Art

Heretofore, a terminal fitting disclosed, for example, in JP HEI 10 (1998)-125362A has been known as a terminal fitting for a wire harness of a motor vehicle. This terminal fitting includes a connecting section to be coupled to a mating conductor and a crimp contact section located in a rearward position from the connecting section so that the crimp contact section is crimped on an end of a core wire in a covered electrical cable to surround the end. If an oxide layer is formed on a surface around the core wire when crimping, an electrical connection is carried out under a condition where the oxide layer is interposed between the core wire and the crimp contact section. Consequently, there is a problem that a contact resistance will become great. Accordingly, in the prior art, a plurality of laterally elongated depressions that intersect an axial direction of the core wire are arranged in a back-and-forth direction on a contact surface that surround the end of the core wire, so that opening edges around the depressions penetrate the oxide layer on the core wire upon crimping to contact with inner conductors.

However, in the above structure, only the laterally elongated edges contact with the inner conductors in the core wire. In order to increase a whole length of each opening edge that contributes to enhance a performance in electrical connection, there is an idea that a plurality of polygonal depressions are arranged on the contact surface in a back-and-forth direction and in a right and left direction and that not only the edges extending in the right and left direction but also the edges extending in the back-and-forth direction are brought into contact with the inner conductors. However, the polygonal depressions are inevitably provided with angled corner portions. The core wire will engages with most straight edges of the depressions upon crimping and will not be able to engage with the angled corner portions.

In view of the above problems, an object of the present invention is to provide a terminal fitting and an electrical cable equipped with the same in which a whole periphery of an opening edge around a depression (including an edge around an angled corner portion) penetrates an oxide layer on a core wire to contact with inner conductors.

SUMMARY OF THE INVENTION

A terminal fitting of the present invention comprises: a connecting section to be coupled to a mating conductor; a crimp contact section to be crimped on an end of a core wire in a covered electrical cable so as to surround the end; a plurality of depressions provided on a contact surface of the crimp contact section for surrounding the core wire. The crimp contact section is located in a rearward position from the connecting section. The core wire includes a plurality of metallic strands and is covered with a sheath to form the covered electrical cable. Each of the depressions is formed into a polygonal shaped recess with which the core wire engages upon crimping. At least one of corner portions of the each depression is rounded.

According to the above structure, the core wire engages with the depressions upon crimping and the opening edge around each of the depressions penetrates an oxide layer on a core wire to contact with the inner conductors. In this case, since at least one of the corner portions of each depression is rounded, the core wire will engage with the rounded corner to penetrate the oxide layer on the core wire, thereby contacting with the inner conductors. Accordingly, the whole periphery of an opening edge around each depression penetrates an oxide layer on a core wire to contact with the inner conductors.

The following constructions will be preferable as embodiments of the present invention.

Each of the depressions is formed into a quadrangular shape including a pair of orthogonal side portions that are disposed at a front position and a back position on the contact surface to extend in a direction substantially orthogonal to an axial direction of the core wire, and a pair of adjacent side portions that are disposed adjacent to the orthogonal side portions on the contact surface and are disposed on right and left positions of the orthogonal side portions. The depressions are juxtaposed in an extending direction of the orthogonal side portions and in an extending direction of the adjacent side portions.

According to the above structure, since the projections in a die that forms the depressions in a pressing process are juxtaposed in the extending directions of the orthogonal side portions and adjacent side portions, grooves between the projections can be formed by a cutting machine, thereby easily producing the die.

Each of the depressions is provided with an opening edge having a substantially parallelogram. A pair of acute diagonal corner portions of the opening edge may be rounded.

In the case where the corner portions are acute, it is difficult in fact to embed the core wire into the corner portions. On the contrary, according to the above structure, since a pair of acute diagonal corner portions of the opening edge are rounded, it is possible to embed the core wire even in the diagonal corner portions.

A pair of obtuse diagonal corner portions of the opening edge may be angled. If the corner portions are obtuse, it is easy to embed the core wire in the corner portions. Thus, according to this structure, the diagonal corner portions are angled and these angled diagonal corner portions catch the core wire, thereby effectively restraining the core wire from moving in the axial direction of the core wire and in the direction orthogonal to the axial direction of the core wire.

The depressions disposed adjacent to each other in a back-and-forth direction may be arranged in a staggered manner to be overlapped on one another in the extending direction of the orthogonal side portions. According to this structure, it is possible to eliminate the line on which the depressions are not arranged in the axial direction of the core wire. That is, since more depressions are arranged closely, it is possible to increase the whole lengths of the opening edges around the depressions.

Straight edges except the corner portions at any one of the pair of orthogonal side portions may be arranged to be overlapped on one another in the extending direction of the orthogonal side portions. According to this structure, it is possible to eliminate the line on which the straight edges of the depressions are not arranged in the axial direction of the core wire. Accordingly, since the core wire engages with the straight edges at a whole width in the extending direction of the orthogonal side portions, it is possible to enhance a fixing force on the crimp contact section, thereby positively restraining the core wire from moving in the axial direction of the core wire.

The present invention is also directed to an electrical cable equipped with a terminal fitting. A core wire including a plurality of metallic strands is covered with a sheath to form an covered electrical cable. Any one of the above terminal fitting is crimped on an end of the core wire. The metallic strands may be made of aluminum or aluminum alloy.

According to the present invention, a whole periphery of an opening edge around each depression can penetrate an oxide layer on a core wire to contact with the inner conductors.

DETAILED DESCRIPTION OF THE PREFERRED EMBODIMENTS

<First Embodiment>

Figure 1:
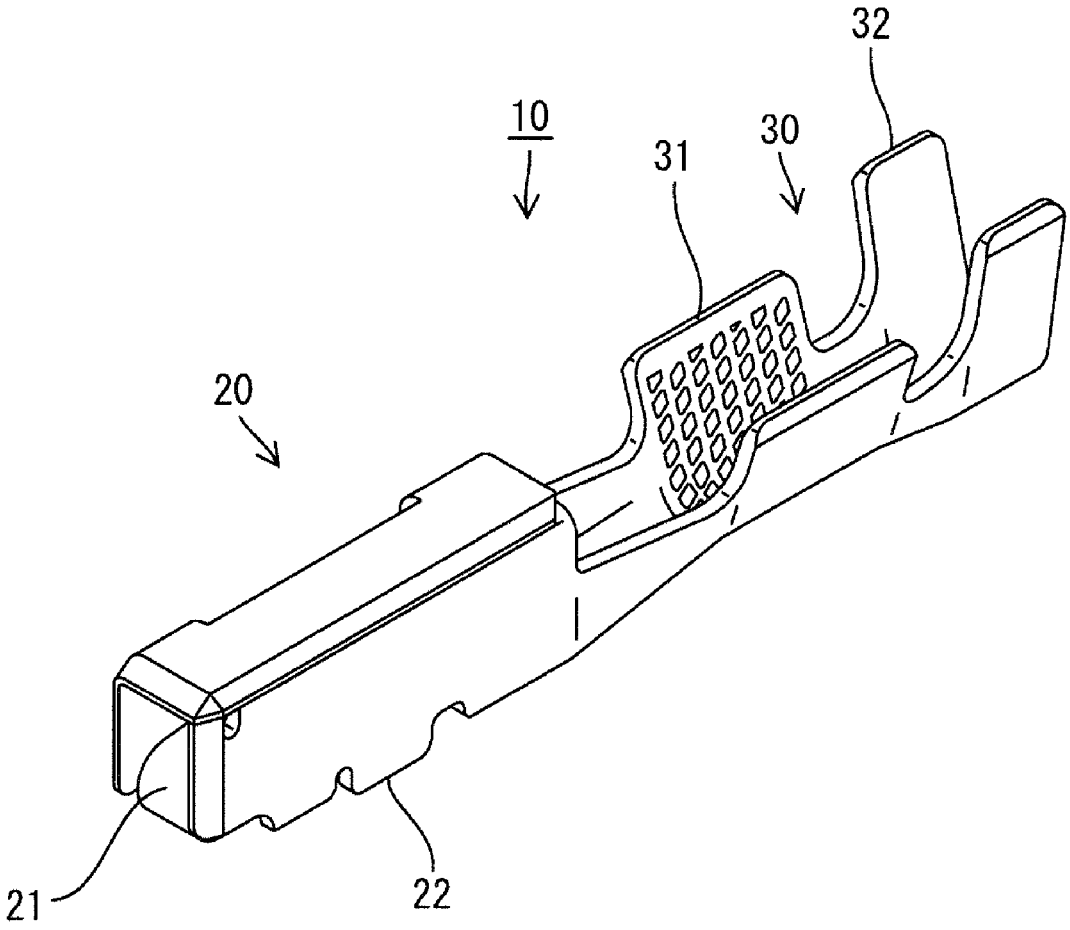
FIG. 1 is a perspective view of a first embodiment of a terminal fitting in accordance with the present invention.

Referring now to FIGS. 1 to 6, a first embodiment of a terminal fitting in accordance with the present invention will be explained below. As shown in FIG. 1, a terminal fitting 10 in the first embodiment includes a main body section 20 (an example of "a connecting section" in the present invention) having a square tube-like configuration, and a crimp contact section 30 located on a rearward position from the main body section 20. The crimp contact section 30 is crimped on an end of a covered electrical cable 40 to surround the end. Although the terminal fitting 10 is described as a female terminal fitting having the main body section 20 in the first embodiment, the terminal fitting 10 may be a male terminal fitting having a tab.

Figure 2:
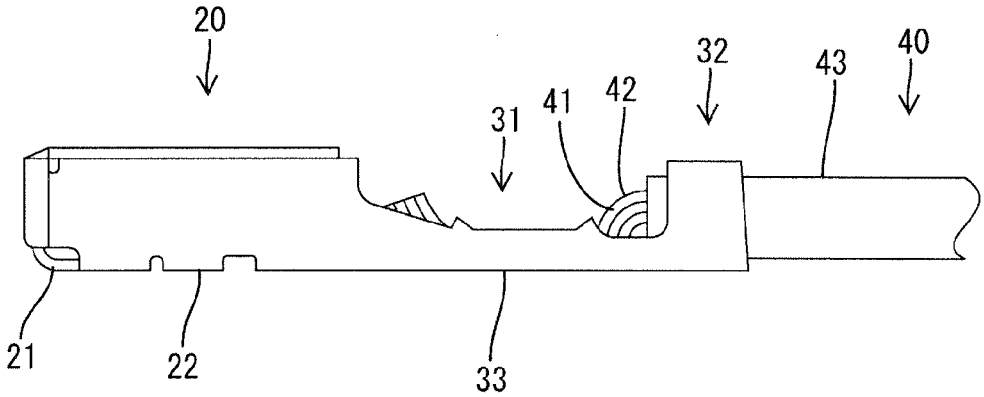
FIG. 2 is a side elevation view of the terminal fitting shown in FIG. 1.

As shown in FIG. 2, the covered electrical cable 40 is an aluminum electrical cable in which a core wire 42 comprising a plurality of metallic strands 41 is covered with a sheath 43 made of insulation synthetic resin. In the first embodiment, the covered electrical cable 40 has 0.75 sq. (square) in cross section and includes eleven metallic strands 41. The metallic strands 41 may be made of any metal such as copper, copper alloy, aluminum, aluminum alloy. The metallic strands 41 in the first embodiment are made of aluminum alloy.

The main body section 20 is provided in its interior with a elastic contact piece 21 that can be elastically deformable and is formed by bending a front side edge of a bottom surface 22 of the main body section 20 backward. A space between the elastic contact piece 21 and a surface (not shown) opposed to the piece 21 in the interior of the main body section 20 is adapted to receive a tab-like mating conductor (not shown).

A distance between the elastic contact piece 21 in a natural state and the opposed surface is set to be slightly smaller than a thickness of the mating conductor. Thus, when the mating conductor is inserted into the space between the piece 21 and the opposed surface while deflecting the elastic contact piece 21, the elastic contact piece 21 is brought into elastic and electrical contact with the mating conductor.

The crimp contact section 30 includes a substantially U-shaped wire barrel portion 31, and a substantially U-shaped insulation barrel portion 32 located on a backward position from the wire barrel portion 31. The wire barrel portion 31 and insulation barrel portion 32 include a base surface 33 that is continued to the bottom surface 22 of the main body section 20 and extends in a back-and-forth direction (in an axial direction of the core wire 42), and a pair of crimping pieces 31A and 32A (FIG. 3) that extend upward from opposite sides of the base surfaces 33 to be opposed to each other, respectively.

Figure 3:
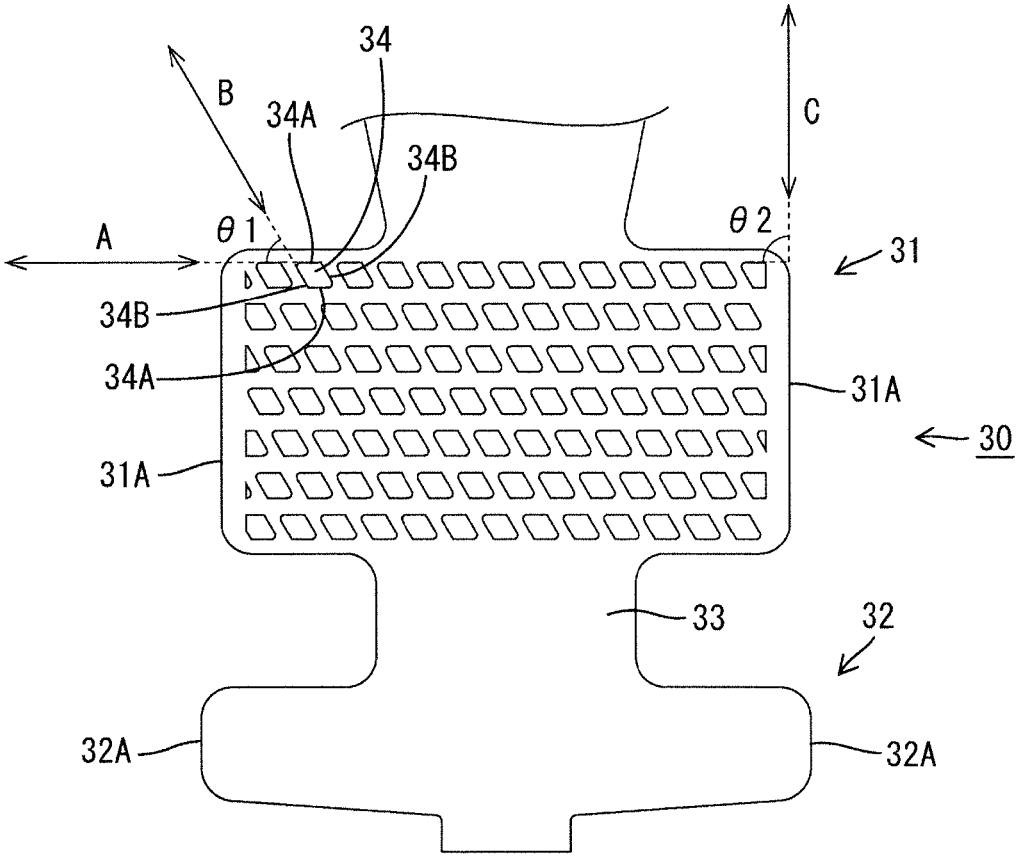
FIG. 3 is a plan view of a developed crimp contact section of the terminal fitting in the first embodiment shown in FIG. 1.

As shown in FIG. 2, the wire barrel portion 31 can hold the core wire 42 by crimping the both crimping pieces 31A onto the core wire 42 in the covered electrical cable 40. Similarly, the insulation barrel portion 32 can hold the sheath 43 and core wire 42 by caulking the both caulking pieces 32A onto the sheath 43 of the covered electrical cable 40. As shown in FIG. 3, when the wire barrel portion 31 is under a developed state before crimping the electrical cable, the wire barrel portion 31 is formed into an elongated rectangular shape that extends in a right and left direction (in a direction orthogonal to a back-and-forth direction).

As shown in FIG. 3, the wire barrel section 31 is provided on it surface adapted to enclose an end of the core wire 42 with a plurality of serrations 34 (an example of depressions in the present invention) with which the core wire 42 engages upon crimping. Each serration 34 is formed into a polygonal recess having a substantially parallelogram opening edge. Specifically, each serration 34 includes a pair of front and rear orthogonal side portions 34A that extend in a right and left direction, and a pair of adjacent side portions 34B that are disposed adjacent to and on both sides of the orthogonal side portions 34A. The side portions 34A and 34B define a substantially parallelogram. In the first embodiment, an angle $\theta 1$ (theta one) of an extending direction (a direction shown by an arrow B in FIG. 3) of the adjacent side portions 34B with respect to an extending direction (a direction shown by an arrow A in FIG. 3) of the orthogonal side portions 34A is set to be about 60 degrees. Also, an angle $\theta 2$ (theta two) of the extending direction of the orthogonal side portions 34A with respect to an axial direction (a direction shown by an arrow C in FIG. 3 and in a back-and-forth direction) of the core wire 42 is set to be 85 to 95 degrees.

Next, an arrangement of the serrations 34 will be explained below. The serrations 34 are aligned in a right and left direction and are spaced apart from one another by a given distance. The serrations 34 are also aligned in the extending direction of the adjacent side portions 34B and are spaced apart from one another by a given distance. The serrations 34 that are disposed adjacent to one another in a back-and-forth direction are arranged in a staggered manner so as to be overlapped on one another in the right and left direction.

Figure 4:
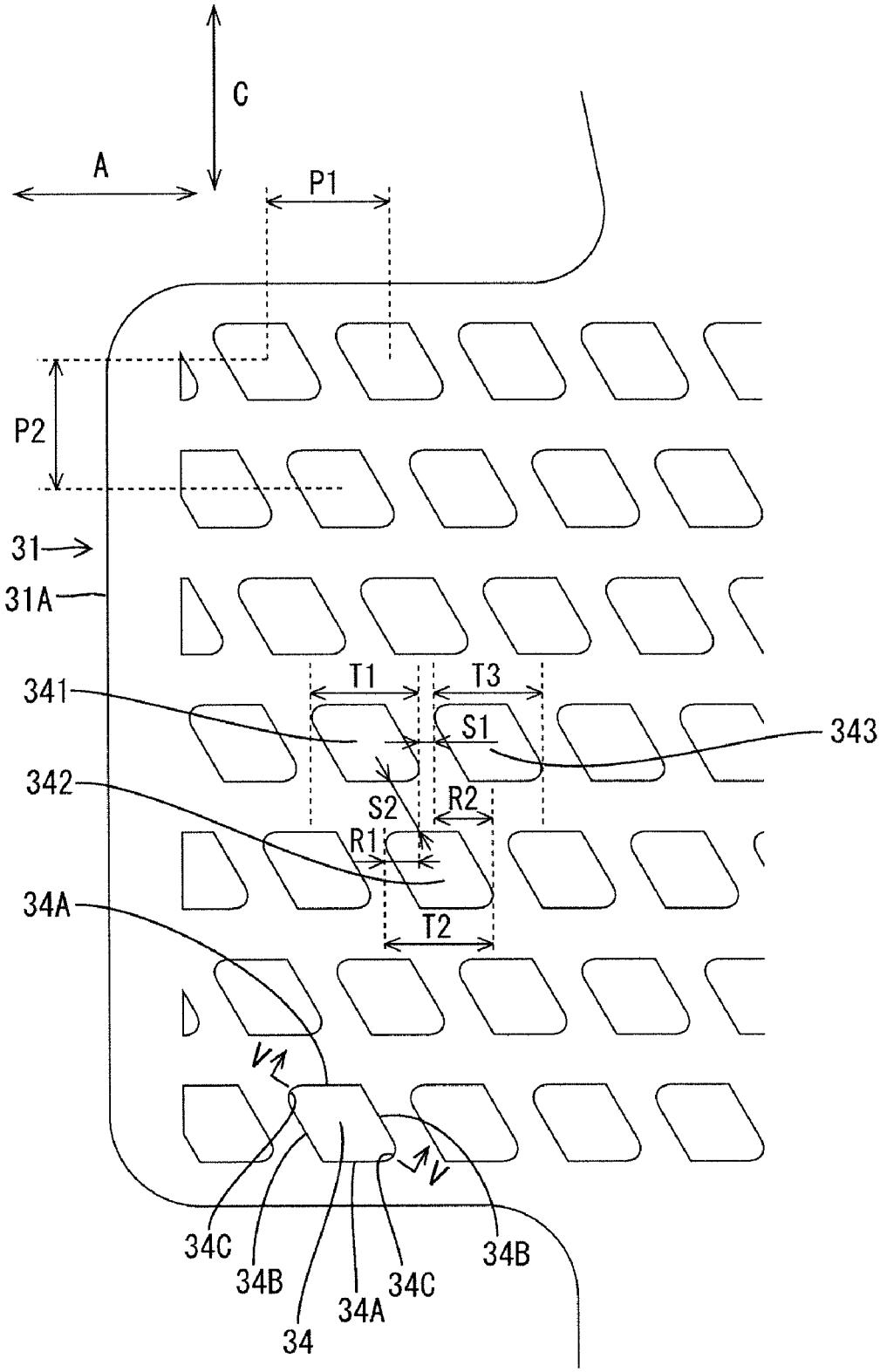
FIG. 4 is an enlarged plan view of the crimp contact section shown in FIG. 3.

The arrangement of the serrations 34 will be explained in more detail by referring to FIG. 4. Firstly, it is assumed that an area which a first serration 341 occupies in the right and left direction designates "T1", an area which a second serration 342 disposed at a slant backward position from the first serration 341 occupies in the right and left direction designates "T2", and an area which a third serration 343 disposed at a right side from the first serration 341 occupies in the right and left direction designates "T3".

Then, the first and second serrations 341 and 342 are overlapped on each other in the right and left direction on an area R1. The second and third serrations 342 and 343 are overlapped on each other in the right and left direction on an area R2. Thus, there is no line in which any serration does not exist in the back-and-forth direction. Accordingly, it is possible to closely arrange more serrations 34.

A clearance S1 between the serrations 341 and 343 in the right and left direction is set to be shorter than a length of each adjacent side portion 34B. Furthermore, a clearance S2 between the serrations 341 and 342 in the extending direction of the adjacent side portion 34B is set to be shorter than a length of each orthogonal side portion 34A. Accordingly, it is possible to increase a whole length of the opening edge of each serration 34 in comparison with a prior art structure in which only the orthogonal side portions 34A constitute the serrations mainly.

A distance P1 between the serrations 34 in the right and left direction is set to be equal to or greater than 0.1 mm (millimeters) and equal to or smaller than 0.8 mm (millimeters). In the first embodiment, the distance P1 is set to be 0.5 mm (millimeters). The distance P1 designates a distance between a midpoint on a diagonal line of one serration 34 and a midpoint on a diagonal line of the other serration 34 adjacent the one serration 34 in the right and left direction.

A distance P2 between the serrations 34 in the back-and-forth direction is set to be equal to or greater than 0.3 mm (millimeters) and equal to or smaller than 0.8 mm (millimeters). In the first embodiment, the distance P2 is set to be 0.5 mm (millimeters). The distance P2 designates a distance between a midpoint on a diagonal line of one serration 34 and a midpoint on a diagonal line of the other serration 34 adjacent to the one serration 34 in the slant direction (in the extending direction of the adjacent side portion 34B).

Next, an effect obtained by embedding the core wire 42 in the serrations 34 will be explained below. When the core wire 42 is crimped by the wire barrel portion 31, the core wire 42 is embedded in the serrations 34. Since the embedded portions of the core wire 42 are engaged with the orthogonal side portions 34A in the back-and-forth direction, this will contribute to enhance a fixing force that can restrain movement of the core wire 42 in the back-and-forth direction. At the same time, since the opening edges around the serrations 34 penetrate an oxide layer generated on the surface of the core wire 42 to contact with the inner conductors, this will contribute to enhance a performance in electrical connection.

In other words, to increase the whole lengths of the opening edges around the serrations 34 will contribute to enhance a performance in electrical connection. However, a method for embedding the core wire 42 in the serrations 34 by crimping is difficult in embedding the core wire 42 in corner portions on which the orthogonal side portions 34A and adjacent side portions 34B are coupled to one another. In particular, in the case where the corner portions are sharp or acute, this inclination will become remarkable.

Figure 5:
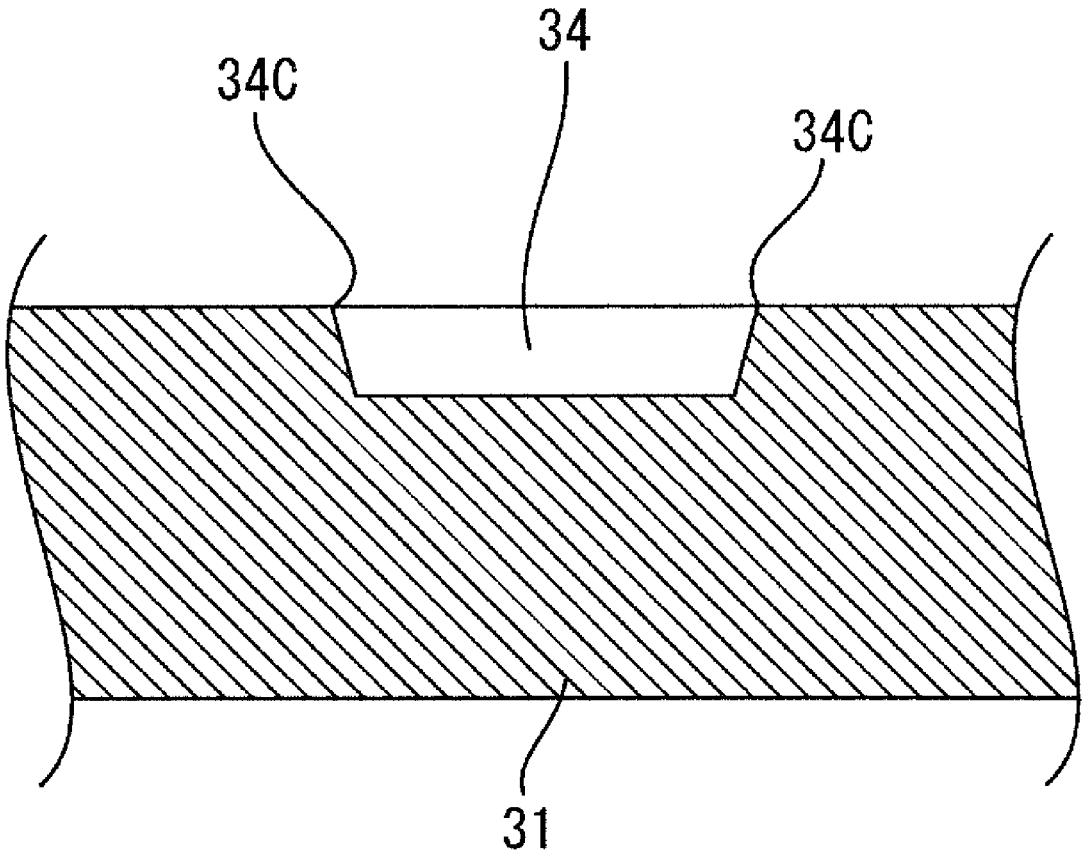
FIG. 5 is a cross section view of a serration taken along lines V-V in FIG. 4.
Figure 6:
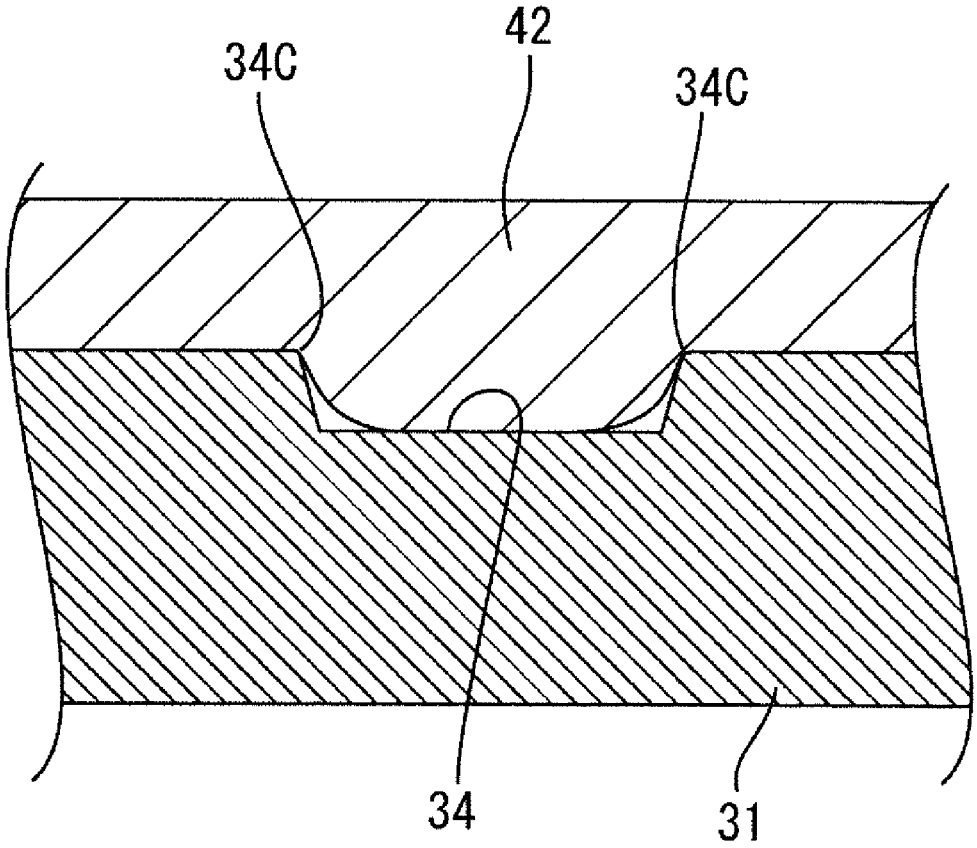
FIG. 6 is a cross section view similar to FIG. 5, illustrating the serration in which a core wire is embedded.

Accordingly, in the first embodiment, a pair of acute diagonal corner portions at the parallelogram opening edge of each serration 34 are rounded, so that the core wire 42 can be embedded even at the diagonal corner portions 34C. FIG. 5 is a cross section view taken along lines V-V in FIG. 4 (a cross section view taken along both diagonal corner portions), illustrating the serration before embedding the core wire 42. FIG. 6 shows the serration 34 in which the core wire 42 is embedded in connection with crimping in FIG. 5. Thus, the opening edges around the serrations 34 even at the both diagonal corner portions 34C penetrate the oxide layer on the core wire 42 to contact with the inner conductors. On the other hand, a pair of obtuse diagonal corner portions at the parallelogram opening edges around the serrations 34 (the diagonal corner portions except the above diagonal corner portions 34C out of the opening edges around the serrations) are angled edge-like shape. Even if the pair of obtuse diagonal corner portions are not rounded, it is possible to embed the core wire 42 in the serrations 34. Even if the core wire 42 moves in the axial direction and the direction perpendicular to the axial direction, these angled diagonal corner portions will catch the core wire 42 effectively, thereby restraining the core wire 42 from moving the above directions.

Next, a structure of a die for pressing the crimp section 30 will be briefly explained below. Although the die is not shown in the drawings, projections in the die for forming the serrations are aligned in the back-and-forth direction and spaced apart from one another by a given distance. The projections are also aligned in the extending direction of the adjacent side portions 34B and spaced apart from one another by a given distance. That is, grooves between the adjacent projections are aligned in the back-and-forth direction and in the extending direction of the adjacent side portions 34B. These grooves can be formed by a cutting machine. Accordingly, only curved surfaces of the projections corresponding to the diagonal corner portions 34C can be formed by an electric discharge machine. This can make it easy to produce the die.

The terminal fitting in the first embodiment is constructed above. Next, a method for producing an electrical cable equipped with the terminal fitting will be described below. Firstly, the sheath 43 is stripped at an end of the covered electrical cable 40 to expose the core wire 42. Secondly, the core wire 42 is disposed on the contact surface of the wire barrel portion 31, and the sheath 43 is disposed on the contact surface of the insulation barrel portion 32. Thirdly, the crimping pieces 31A of the wire barrel portion 31 and the crimping pieces 32A of the insulation barrel portion 32 are crimped onto the core wire 42 and the sheath 43, so that the core wire 42 is secured to the wire barrel 31 and the sheath 43 and core wire 42 are secured to the insulation barrel portion 32. Then, the electrical cable equipped with the terminal fitting is completed.

As described above, since the both diagonal corner portions 34C at the opening edges around the serrations 34 are rounded in the first embodiment, a substantially whole peripheries of the opening edges around the serrations 34 penetrate the oxide layer on the core wire 42, so that the wire barrel 31 can contact with the inner conductors. Since the serrations 34 are aligned in the right and left direction and in the slant direction, it is possible to easily cut the grooves between the projections that constitute the serrations in the die for pressing the crimp contact section 30. Furthermore, the serrations 34 are arranged in the staggered manner so that the serrations 34 are overlapped on one another in the right and left direction, it is possible to eliminate lines on which no serration exists in the back-and-forth direction, it is possible to closely arrange more serrations, and it is possible to increase the whole lengths of the opening edges around the serrations 34.

<Second Embodiment>

Figure 7:
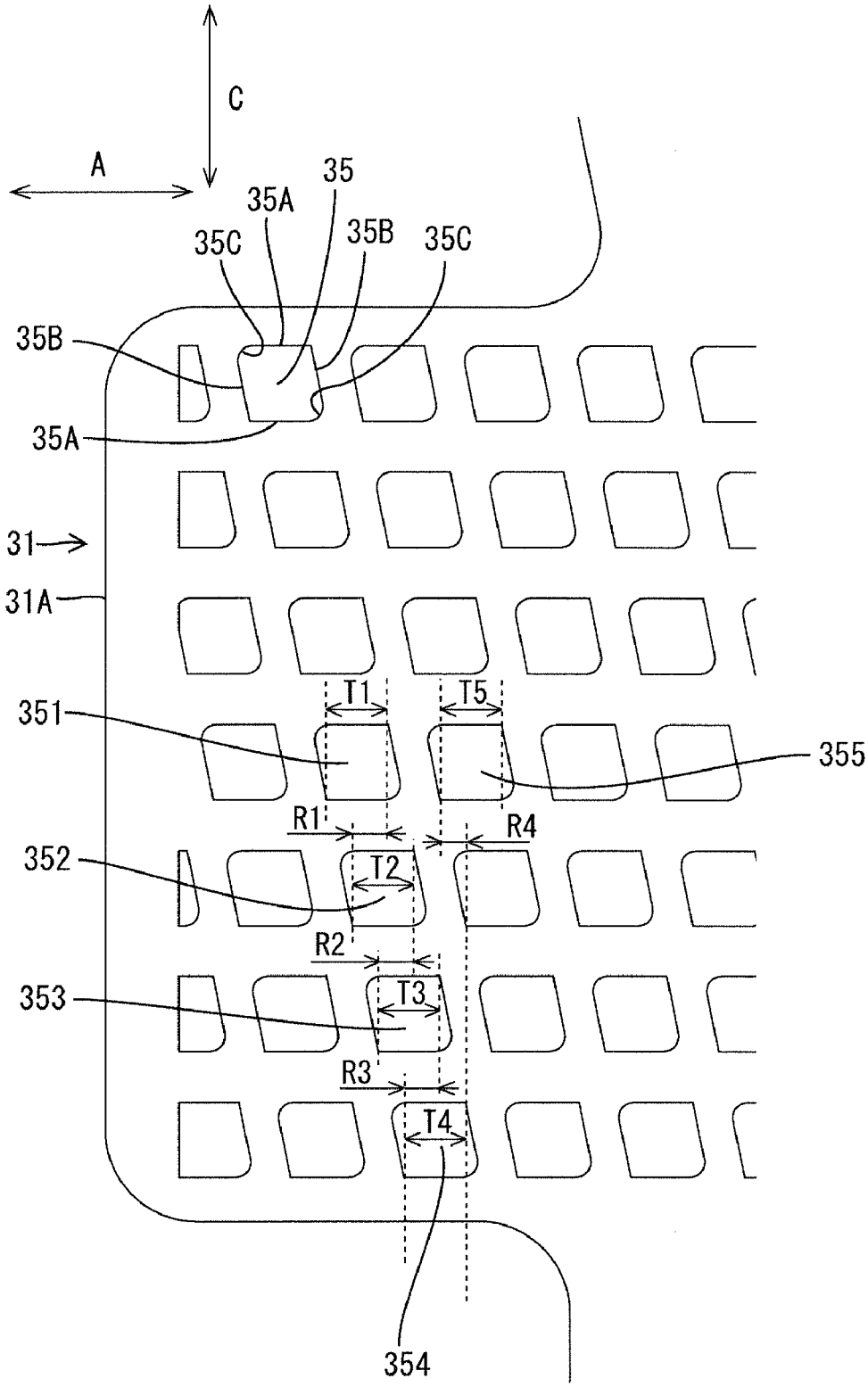
FIG. 7 is an enlarged plan view of the crimp contact section in a second embodiment of the terminal fitting in accordance with the present invention.

Next, referring now to FIG. 7, a second embodiment of the terminal fitting in accordance with the present invention will be described below. Since the terminal fitting in the second embodiment alters a part of a construction of the serrations 34 in the first embodiment, the other overlapped constructions, operations, and effects will be omitted below.

Each serration 35 in the second embodiment includes a pair of front and back orthogonal side portions 35A that extend in a right and left direction, and a pair of adjacent side portions 35B that are disposed adjacent to and on both sides of the orthogonal side portions 35A, as is the case with the first embodiment. The side portions 35A and 35B define a substantially parallelogram. A pair of angled diagonal corner portions 35C at the opening edge around the parallelogram of each serration 35 are rounded, so that the core wire 42 can be embedded even in the diagonal corner portions 35C, as is the case with the first embodiment.

Next, an arrangement of the serrations 35 will be explained below. The serrations 35 are aligned in a right and left direction and are spaced apart from one another by a given distance. The serrations 35 are aligned in the extending direction of the adjacent side portions 35B and are spaced apart from one another by a given distance. Straight edges of one of orthogonal side portions 35A except the diagonal corner portions 35C are arranged to be overlapped on one another in the right and left direction. In order to avoid a redundant explanation of the orthogonal side portions 35A in the back-and-forth direction, a front orthogonal side portion 35A will be described below as a representative example.

An arrangement of the serrations 35 will be explained below in detail by referring to FIG. 7. Firstly, it is assumed that an area which straight edges of any first serration 351 occupy in the right and left direction designates "T1", an area which straight edges of a second serration 352 disposed at a slant backward position from the first serration 351 occupy in the right and left direction designates "T2", an area which straight edges of a third serration 353 disposed at a slant backward position from the second serration 352 occupy in the right and left direction designates "T3", an area which straight edges of a fourth serration 354 disposed at a slant backward position from the third serration 353 occupy in the right and left direction designates "T4", and an area which straight edges of a fifth serration 355 disposed at a right position from the first serration 351 occupy in the right and left direction designates "T5".

Then, the respective straight edges are overlapped on one another in an area R1 between the first and second serrations 351 and 352, are overlapped on each other in the right and left direction in an area R2 between the second and third serrations 352 and 353, are overlapped on each other in the right and left direction in an area R3 between the third and fourth serrations 353 and 354, and are overlapped on each other in the right and left direction in an area R4 between the fourth and fifth serrations 354 and 355. Thus, it is possible to eliminate any line in which any straight edge does not exist in the back-and-forth direction. Accordingly, since the core wire 42 engages the straight edges over the whole widths in the right and left direction, it is possible to enhance a fixing force of the wire barrel portion 31 and to surely prevent the core wire 42 from moving in the back-and-forth direction.

<The Other Embodiments>

It should be noted that the present invention is not limited to the above embodiments described above and illustrated in the drawings. For example, the following embodiments will be fallen within a technical scope of the present invention.

(1) Although the respective serrations are aligned in the right and left direction and are spaced apart from one another by the given distance in the above embodiments, the serrations may be spaced apart from one another in the right and left direction by different distances in the present invention. Similarly, the respective serrations may be spaced apart from one another in the extending directions of the adjacent side portions by different distances.

(2) Although each serration has the substantially parallelogram opening edges in the above embodiments, the serration may has opening edges in a triangular shape or a square shape in the present invention. In this case, all of the corner portions of the serration may be rounded.

(3) Although one serration is provided with a pair of adjacent side portions in the above embodiments, the one serration may be provided with plural pairs of adjacent side portions in the present invention.

(4) Although the straight edges are overlapped on one another between the fourth and fifth serrations 354 and 355 in the above second embodiment, the straight edges may be overlapped on one another between the second and fifth serrations 352 and 355 in the present invention. That is, the straight edges may be arranged in the staggered manner so that the straight edges are overlapped on one another in the right and left direction.

(5) Only one of corner portions of each serration may be rounded.

The invention claimed is:

1. A terminal fitting comprising:

a connecting section to be coupled to a mating conductor;

a crimp contact section to be crimped on an end of a core wire in a covered electrical cable so as to surround said end, said crimp contact section being located in a rearward position from said connecting section, said core wire including a plurality of metallic strands and being covered with a sheath to form said covered electrical cable; and a plurality of depressions provided on a contact surface of said crimp contact section for surrounding said core wire, each of said depressions being formed into a polygonal shaped recess with which said core wire engages upon crimping, each of the polygonal shaped recesses having at least three substantially straight portions intersecting at least at three corner portions, at least a first of the straight portions of each said depression being aligned to a second of the straight portions of the respective depression at an acute angle, and the first and the second straight portions of each said depression intersecting one another at a corner portion that is rounded.

2. A terminal fitting according to claim 1, wherein each of said depressions is formed into a quadrangular shape including a pair of the side portions defining orthogonal side portions that are disposed at a front position and a back position on said contact surface to extend in a direction substantially orthogonal to an axial direction of said core wire, the side portions further including a pair of adjacent side portions that are disposed adjacent to said orthogonal side portions on said contact surface and are disposed on right and left positions of said orthogonal side portions, said depressions are juxtaposed in an extending direction of said orthogonal side portions and in an extending direction of said adjacent side portions.

3. A terminal fitting according to claim 2, wherein each of said depressions is provided with an opening edge defining a substantially parallelogram, two of the corner portions defining a pair of acute diagonal corner portions on said opening edge, the acute diagonal corner portions being rounded.

4. A terminal fitting according to claim 3, wherein said opening edge further defines a pair of obtuse diagonal corner portions that are angled.

5. A terminal fitting according to claim 2, wherein said depressions disposed adjacent to each other in a back-and-forth direction are arranged in a staggered manner to be overlapped on one another in said extending direction of said orthogonal side portions.

6. A terminal fitting according to claim 2, wherein straight edges except said corner portions at any one of said pair of orthogonal side portions are arranged to be overlapped on one another in said extending direction of said orthogonal side portions.

7. An electrical cable assembly, comprising a core wire including a plurality of metallic strands covered with a sheath to form a covered electrical cable, and the terminal fitting according to claim 1 crimped on an end of said core wire.

8. An electrical cable assembly according to claim 7, wherein said metallic strands are made of aluminum or aluminum alloy.

* * * * *